US008011891B2

(12) United States Patent
Ochiai et al.

(10) Patent No.: US 8,011,891 B2
(45) Date of Patent: Sep. 6, 2011

(54) CENTRIFUGAL MULTIBLADE FAN

(75) Inventors: Toshinori Ochiai, Obu (JP); Masaharu Sakai, Obu (JP); Hideki Seki, Nagoya (JP)

(73) Assignee: Denso Corporation, Kariya (JP)

( * ) Notice: Subject to any disclaimer, the term of this patent is extended or adjusted under 35 U.S.C. 154(b) by 1004 days.

(21) Appl. No.: 11/715,743

(22) Filed: Mar. 8, 2007

(65) Prior Publication Data

US 2007/0217908 A1 Sep. 20, 2007

(30) Foreign Application Priority Data

Mar. 15, 2006 (JP) ..... 2006-070383
Oct. 18, 2006 (JP) ..... 2006-283711

(51) Int. Cl.
*F04D 29/28* (2006.01)

(52) U.S. Cl. ..... 416/188; 416/223 B; 416/243

(58) Field of Classification Search ..... 416/185, 416/186 R, 188, 223 B, 243, DIG. 2; 415/914
See application file for complete search history.

(56) References Cited

U.S. PATENT DOCUMENTS 4,208,169 A * 6/1980 Becker et al. ..... 416/185
4,347,038 A * 8/1982 Hayashi et al. ..... 416/132 A
4,543,041 A * 9/1985 French et al. ..... 416/183
6,007,300 A * 12/1999 Saeki et al. ..... 416/178
6,478,538 B2 * 11/2002 Kim ..... 415/204
6,769,876 B2 * 8/2004 Sakai et al. ..... 416/187
7,422,418 B2 9/2008 Ishijima et al.
2004/0076516 A1 * 4/2004 Bird ..... 415/206

FOREIGN PATENT DOCUMENTS

CN 2133678 5/1993
CN 2133678 Y * 5/1993
JP 38-17526 9/1963
JP 1-193099 8/1989
JP 08-326694 12/1996
JP 2002115694 A * 4/2002
JP 2002-168194 6/2002
JP 2005-106361 4/2005
JP 2006-37839 2/2006

OTHER PUBLICATIONS

Office action dated Apr. 18, 2008 in Chinese Application No. 2007 10086383.9 with English translation.
Office action dated May 17, 2011 in corresponding Japanese Application No. 2006-283711.

* cited by examiner

*Primary Examiner* — Edward Look
*Assistant Examiner* — Jesse Prager
(74) *Attorney, Agent, or Firm* — Harness, Dickey & Pierce, PLC

(57) ABSTRACT

A centrifugal multiblade fan according to the present invention sucks air from one end side of an axial direction of a rotation axis to a radial inside, and blows the air to a radial outside. The centrifugal multiblade fan includes a plurality of blades located around the rotation axis. Each blade has a leading edge positioned at the radial inside, and a trailing edge positioned at a radial outside. The leading edge of each blade has an edge shape with a radius of curvature of 0.2 mm or less, for example.

20 Claims, 7 Drawing Sheets

FIG. 8

| | COMPARATIVE EXAMPLE 2 | FIRST EMBODIMENT |
|---|---|---|
| OUTSIDE DIAMETER [mm] | 80 | 80 |
| INSIDE DIAMETER [mm] | 64 | 64 |
| NUMBER OF BLADES | 31 | 41 |
| INLET ANGLE [deg] | 80 | 80 |
| OUTLET ANGLE [deg] | 20 | 20 |
| STAGGER ANGLE [deg] | 33 | 33 |
| BLADE HEIGHT [mm] | 50 | 50 |
| RADIUS OF CURVATURE OF LEADING EDGE [mm] | R0.5 | (EDGE SHAPE) |
| BLADE THICKNESS [mm] | 1.0 (CONSTANT) | 0.2 (AT LEADING EDGE)<br>0.56 (AT MAXIMUM THICKNESS POSITION)<br>0.2 (AT TRAILING EDGE) |
| MAXIMUM THICKNESS POSITION | (BLADE THICKNESS IS CONSTANT) | MIDDLE OF CHORD |

CENTRIFUGAL MULTIBLADE FAN

CROSS REFERENCE TO RELATED APPLICATION

This application is based on Japanese Patent Applications No. 2006-70383 filed on Mar. 15, 2006 and No. 2006-283711 filed on Oct. 18, 2006, the contents of which are incorporated herein by reference in its entirety.

BACKGROUND OF THE INVENTION

1. Field of the Invention

The present invention relates to a centrifugal multiblade fan which includes a plurality of blades located around a rotation axis.

2. Description of the Related Art

Conventionally, in this kind of the centrifugal multiblade fan, a leading edge (an edge on the rotation axis side) of each blade is formed into a smooth curved shape in cross section to reduce a separation of airflow at the leading edge on some level, and reduces a fan efficiency reduction and a noise generation caused by the separation.

However, when the leading edge of each blade is formed into the smooth curved shape in cross section, a point where the airflow separates and a point where the airflow reattaches are temporally fluctuated. Therefore, the airflow between the blades becomes unstable. As a result, the fan efficiency is reduced and the noise is generated.

A centrifugal multiblade fan that can reduce the separation of the airflow is described in JP-A-2002-168194, for example. In this centrifugal multiblade fan, a tumor having a similar shape as that of a separation area of the airflow is provided at a back surface of each blade. The back surface of each blade is a surface on the side opposite to a rotation direction of the centrifugal multiblade fan, and a ventral surface of each blade is an opposite surface of the back surface.

In this way, the centrifugal multiblade fan according to JP-A-2002-168194 reduces a space where the separation of the airflow generates from the back surface of each blade, and reduces the noise generation caused by the separation.

However, the point where the airflow separates and the point where the airflow reattaches are temporally fluctuated. Furthermore, the tumor is difficult to be completely the same shape as that of the separation area of the airflow. Therefore, the space where the separation of the airflow generates cannot be reduced enough.

SUMMARY OF THE INVENTION

In view of the foregoing problems, it is an object of the present invention to provide a centrifugal multiblade fan in which a fan efficiency is improved and a noise is reduced.

According to a first aspect of the invention, a centrifugal multiblade fan sucks air from one end side of an axial direction of a rotation axis to a radial inside, and blows the air to a radial outside. The centrifugal multiblade fan includes a plurality of blades located around the rotation axis. Each blade has a leading edge positioned at the radial inside, and a trailing edge positioned at a radial outside. The leading edge of each blade has an edge shape with a radius of curvature of 0.2 mm or less.

Because the leading edge is the edge shape with a radius of curvature of 0.2 mm or less, the airflow can be always separated at the leading edge. Therefore, a fluctuation of a separation point and a reattachment point can be prevented, and airflow between the blades can be restricted to be unstable. In addition, when the leading edge is the edge shape, the separation point and the reattachment point can be positioned at an upstream side of the airflow compared with when the leading edge is a smooth curved shape. Therefore, a distance that the airflow can be rectified between the blades on a trailing edge side increases, and the airflow blown from between the blades can be made stable.

As a result, the centrifugal multiblade fan according to the first aspect of the invention can improve the fan efficiency as well as reduce the noise.

According to a second aspect of the invention, a centrifugal multiblade fan sucks air from one end side of an axial direction of a rotation axis to a radial inside, and blows the air to a radial outside. The centrifugal multiblade fan includes a plurality of blades located around the rotation axis. Each blade has a leading edge positioned at the radial inside, and a trailing edge positioned at a radial outside. Each blade has a ventral surface on a forward side in a rotation direction, and a back surface opposite to the ventral surface. The leading edge has a first angle part on a side of the ventral surface, and a second angle part on a side of the back surface, and at least the second angle part has an edge shape.

Because the second angle part is the edge, the airflow can be always separated from the line of the back surface at the second angle part. Therefore, the fluctuation of the separation point and the reattachment point can be prevented, and airflow between the blades can be restricted to be unstable. In addition, when the second angle part is the edge shape, the separation point and the reattachment point can be positioned at an upstream side of the airflow compared with when the second angle part is a smooth curved shape. Therefore, the distance that the airflow can be rectified between the blades on a trailing edge side increases, and the airflow blown from between the blades can be made stable.

As a result, the centrifugal multiblade fan according to the second aspect of the invention can improve the fan efficiency as well as reduce the noise.

According to a third aspect of the invention, a centrifugal multiblade fan sucks air from one end side of an axial direction of a rotation axis to a radial inside, and blows the air to a radial outside. The centrifugal multiblade fan includes a plurality of blades located around the rotation axis. Each blade has a leading edge positioned at the radial inside, and a trailing edge positioned at a radial outside. The leading edge has an edge-shaped part such that air from the one end side of the axial direction of the rotation axis is always separated at the edge shaped part.

Because the airflow can be always separated at the edge shaped part, the fluctuation of the separation point and the reattachment point can be prevented, and airflow between the blades can be restricted to be unstable. In addition, when the leading edge has the edge-shaped part, the separation point and the reattachment point can be positioned at an upstream side of the airflow compared with when the leading edge does not have the edge shaped part. Therefore, a distance that the airflow can be rectified between the blades on a trailing edge side increases, and the airflow blown from between the blades can be made stable.

As a result, the centrifugal multiblade fan according to the third aspect of the invention can improve the fan efficiency as well as reduce the noise.

BRIEF DESCRIPTION OF THE DRAWINGS

Additional objects and advantages of the present invention will be more readily apparent from the following detailed description of preferred embodiments when taken together with the accompanying drawings. In the drawings:

FIG. 8 is a view showing a specification of blades in the first embodiment and the comparative example 2, used for measuring in FIGS. 7A-7D;

DETAILED DESCRIPTION OF THE PREFERRED EMBODIMENTS

First Embodiment

Figure 1:
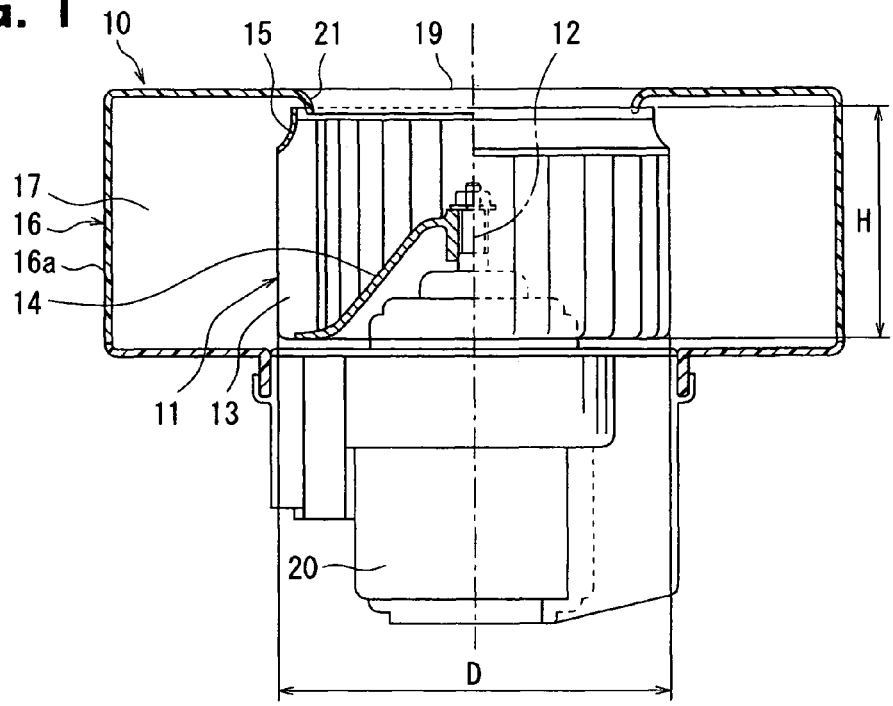
FIG. 1 is a partial cross-sectional view of a blower including a centrifugal multiblade fan according to a first embodiment of the invention.
Figure 2:
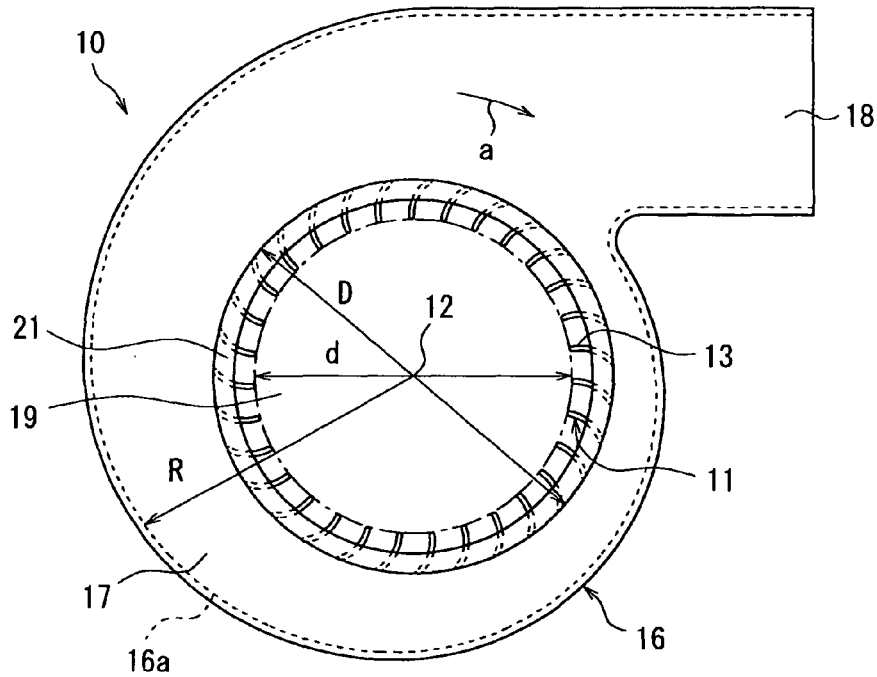
FIG. 2 is a front view of the blower in FIG. 1.

A first embodiment of the invention is described with reference to FIGS. 1-8. A blower 10 including a centrifugal multiblade fan according to a first embodiment of the invention is typically used for a vehicular air conditioner. FIG. 1 is a cross sectional view of a blower 10 including the centrifugal multiblade fan 11 according to the invention. FIG. 2 is a front view of the blower 10.

The centrifugal multiblade fan (hereafter abbreviated as a fan) 11 according to the invention includes a plurality of blades (wings) 13 around a rotation axis (a center line in FIG. 1) 12 and a holding plate (a boss) 14 holding the blades 13. The fan 11 sucks an air from one end side of an axial direction of the rotation axis 12 to a radial inside, and blows the air to a radial outside.

At a suction side (i.e., the one end side of the axial direction of the rotation axis 12) of the fan 11, shrouds 15 formed into a short circular arc shape in cross section are provided so that height H of each blade 13 reduces gradually from the radial inside to the radial outside of the fan 11.

In this embodiment, the blades 13 are formed together with the shrouds 15 piece by piece by resin cutting, and the blades 13 are fixed with the holding plate 14 integrally to form the fan 11. The blades 13 may be formed by metal cutting, and the blades 13, the shrouds 15 and the holding plate 14 may be formed integrally with a resin or a metal.

A resin scroll casing 16 houses the fan 11 therein and forms a spiral flow channel 17 through which the air blown from the fan 11 is joined.

The scroll casing 16 is formed spirally so that the fan 11 is located in its center. A dimension from a scroll side plate 16*a* constituting an external wall of the scroll casing 16 to the rotation axis 12 (a center of the fan 11), i.e., a scroll radius R is set to increase gradually from a scroll beginning side to a scroll end side in the scroll casing 16.

Therefore, a cross sectional area of the flow channel 17 that leads the air blown from the fan 11 to an outlet 18 provided at the end side of the scroll casing 16 expands gradually from the scroll beginning side to the scroll end side of the scroll casing 16.

At a portion of the scroll casing 16 that corresponds to the one end side of the axial direction of the rotation axis 12, an inlet 19 for leading the air to the radial inside of the fan 11 is formed. At a portion corresponding to the other end side of the axial direction, an electric motor 20 as a driving device for driving and rotating the fan 11 is located.

At an outer edge of the inlet 19, a bell mouth 21 for expanding the air to the radial inside of the fan 11 and leading the suction air to the fan 11 is formed integrally with the scroll casing 16.

Figure 3A:
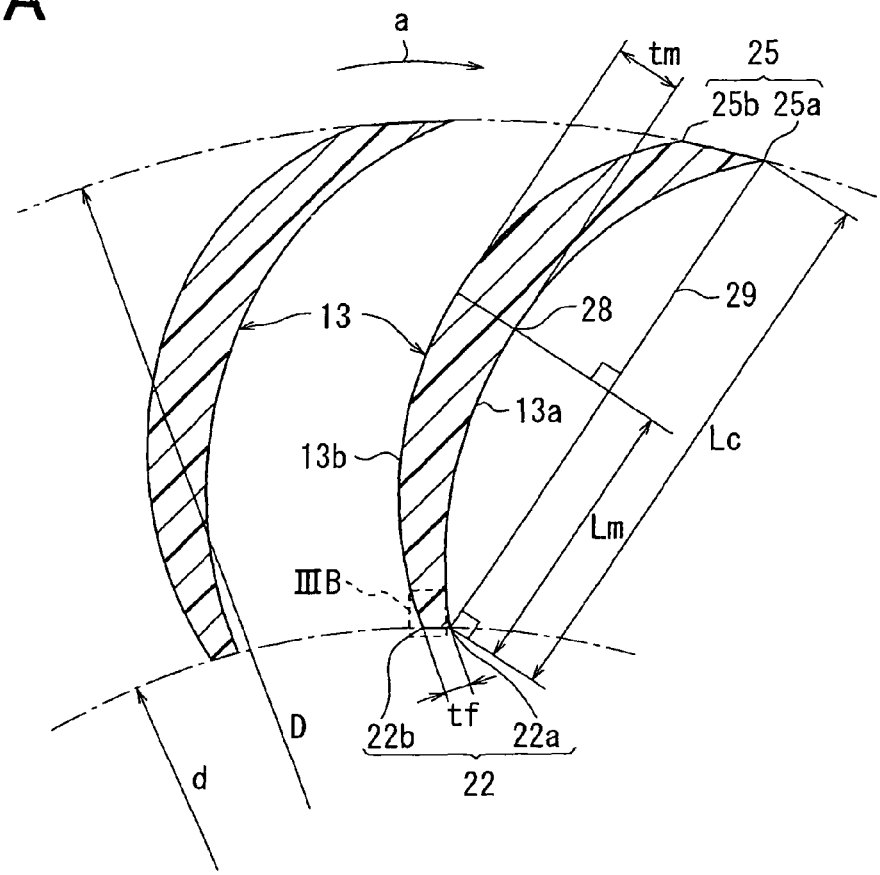
FIG. 3A is an enlarged cross-sectional view showing a part of the centrifugal multiblade fan according to the first embodiment.
Figure 3B:
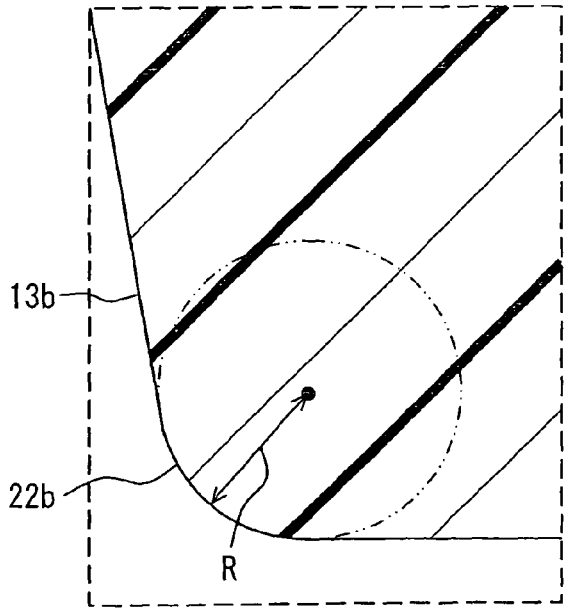
FIG. 3B is an enlargement of box IIIB illustrated in FIG. 3A.

FIG. 3 shows cross-sectional shapes of the blades 13 in a plane surface perpendicular to the rotation axis 12. Each blade 13 has a circular arc shape in cross section. Each blade 13 is arranged so that one end faces to the radial inside of the fan 11 and the other end faces to the radial outside of the fan 11.

A ventral surface (i.e., a surface facing to the rotation direction "a" of the fan 11) 13*a* of each blade 13 is a concave shape, and a back surface (an opposite surface of the ventral surface) 13*b* of each blade 13 is a convex shape.

A leading edge 22 is an edge part of each blade 13 on the radial inside of the fan 11. At the leading edge 22, a first angle part 22*a* on a side of the ventral surface 13*a* and a second angle part 22*b* on a side of the back surface 13*b* are formed separately. The leading edge 22 has a substantially flat surface, and both the angle parts 22*a* and 22*b* have edge shapes.

The first angle part 22*a* is located at a predetermined distance (hereafter called an inside diameter) "d" from the rotation center of the fan 11. In this embodiment, the second angle part 22*b* is also located at the distance of the inside diameter "d" from the rotation center of the fan 11.

A trailing edge 25 is an edge part of each blade 13 on the radial outside of the fan 11. At the trailing edges 25, a third angle part 25*a* on a side of the ventral surface 13*a* and a fourth angle part 25*b* on a side of the back surface 13*b* are formed separately. The trailing edge 25 has a substantially flat surface, and both the angle parts 25*a* and 25*b* have edge shapes.

The third angle part 25*a* is located at a predetermined distance (hereafter called an outside diameter) D from the rotation center of the fan 11. In this case, the fourth angle part 25*b* is also located at the distance of the outside diameter D from the rotation center of the fan 11.

Because the blades 13 are formed by resin cutting in this embodiment, all radiuses of curvature of the above-described angle parts 22*a*, 22*b*, 25*a* and 25*b* are close to zero without limit. When the blades 13 are formed by die forming, the radiuses of curvature of the above-described angle parts 22*a*, 22*b*, 25*a* and 25*b* become about 0.2 mm due to a matter of die making.

Although a camber line of each blade 13 is normally set to a center line of a thickness direction of each blade 13, in this embodiment, the camber line is set on the ventral surface 13*a*. Therefore, a segment connecting the first angle part 22*a* and the third angle part 25*a* becomes a chord 29. The camber line and the chord are defined according to JIS B 0132. A blade thickness, a chord length, an incident angle and a specific noise level are also defined according to JIS B 0132.

The blade thickness of each blade 13 changes in the direction where the chord 29 extends (hereafter, the direction is referred as a chordwise direction). Specifically, the back surface 13*b* of each blade 13 is expanded to a reverse side of the rotation direction "a" of the fan 11 so that the blade thickness of each blade 13 increases gradually from both the leading edge 22 and the trailing edge 25 to a thickness portion 28 in the chordwise direction.

In this case, a ratio (Lm/Lc) of a chordwise distance (Lm) from the leading edge 22 to the thickness portion 28 where the blade thickness of each blade 13 becomes a maximum and a chord length (Lc) from the leading edge to the trailing edge of each blade 13 is set to 0.5. In addition, a ratio (tm/tf) of a maximum blade thickness (tm) of each blade 13 and a blade thickness (tf) at the first and second angle parts 22*a*, 22*b* is set to 2.8.

An operation of the first embodiment having the above configuration is described below. By applying electricity to the motor 20 to drive and rotate the fan 11 in the direction of the arrow "a" in FIG. 2, the fan 11 sucks air from the inlet 19 at one end side of the axial direction of the rotation axis 12 to the radial inside, and blows the sucked air to the radial outside. The air blown from the fan 11 flows to the outlet 18 though the flow channel 17, and is blown from the outlet 18 to an outside of the blower 10.

Figure 4:
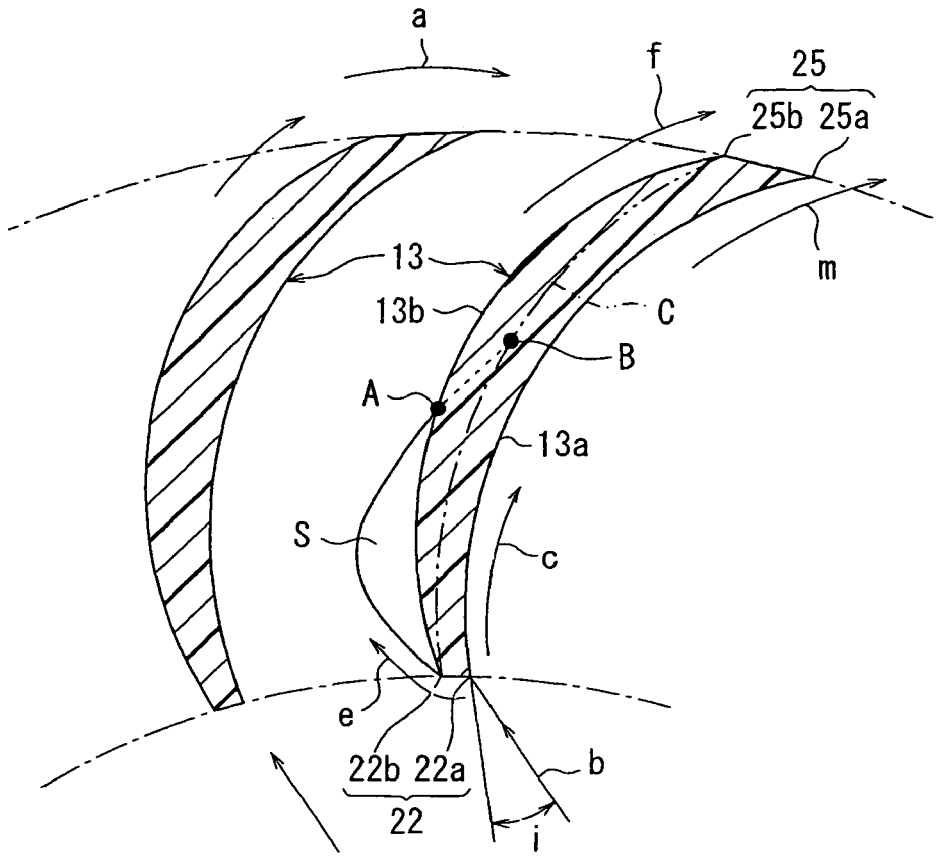
FIG. 4 is a pattern diagram showing airflow between blades of the centrifugal multiblade fan according to the first embodiment.

FIG. 4 is a pattern diagram showing airflow between the blades 13. As shown by the arrow "b", air drawn from the inlet 19 flows toward each blade 13 at an incident angle "i". In the air flowing toward each blade 13, air hit against the ventral surface 13*a* of each blade 13 flows along the concave shape of the ventral surface 13*a* as shown by the arrow "c", and is blown to the radial outside of the fan 11 as shown by the arrow "m".

On the other hand, in the air flowing toward each blade 13, air hit against the leading edge 22 flows toward a side of the back surface 13*b* as shown by the arrow "e". However, the air cannot flow along the line of the back surface 13*b* because the second angle part 22*b* has the edge shape with the radius of curvature of 0.2 mm or less. Therefore, the airflow always separates from the line of the back surface 13*b* by the second angle part 22*b*.

The separated airflow reattaches to each blade 13 in a vicinity of a central part of the chordwise direction as shown by a reattachment point A on the back surface 13*b*. On the side of the back surface 13*b* of each blade 13, a separation area S of the airflow is formed. The air reattached to the back surface 13*b* of each blade 13 flows along the convex shape, and is blown to the radial outside of the fan 11 as shown by the arrow "f".

In FIG. 4, a dashed-two dotted line C is the back surface 13*b* of each blade 13 in a comparative example 1, in which the blade thickness is substantially constant in the chordwise direction. A point B in FIG. 4 shows the reattachment point in the comparative example 1.

In the first embodiment, the back surface 13*b* of each blade 13 is expanded to the reverse side of the rotation direction "a" of the fan 11 so that the blade thickness increases gradually from both the leading edge 22 and the trailing edge 25 to the thickness portion 28 in the chordwise direction. Therefore, the space where the separation of the airflow generates on the side of the back surface 13*b* can be reduced.

More specifically, the reattachment point A in the first embodiment can be positioned at a side of the leading edge 22 than the reattachment point B in the comparative example 1. In the first embodiment, the separation area S of the airflow can be smaller than that in the comparative example 1, so the fan efficiency η reduction and the noise generation caused by the airflow separation are more reduced than those in the comparative example 1.

The fan efficiency η is expressed by $\eta = Q \times Pt/(L \times N)$, wherein Q is an air volume ($m^3$/sec), Pt is a fan total pressure (Pa), L is a shaft power (N·m) and N is a rotation speed (rad/sec).

Figure 5A:
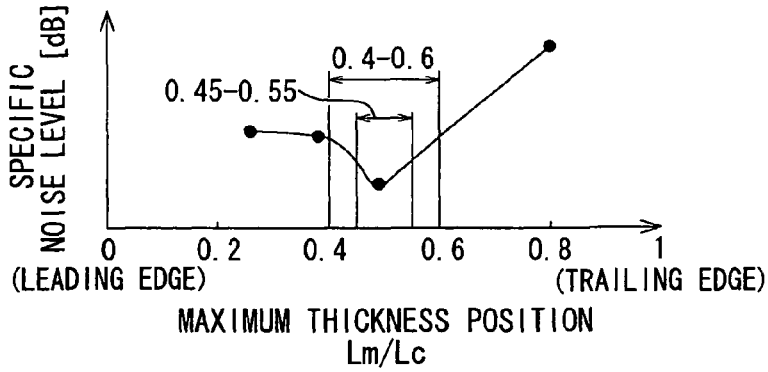
FIG. 5A is a graph showing a relationship between a maximum thickness position of the blades of the centrifugal multiblade fan and a specific noise level.
Figure 5B:
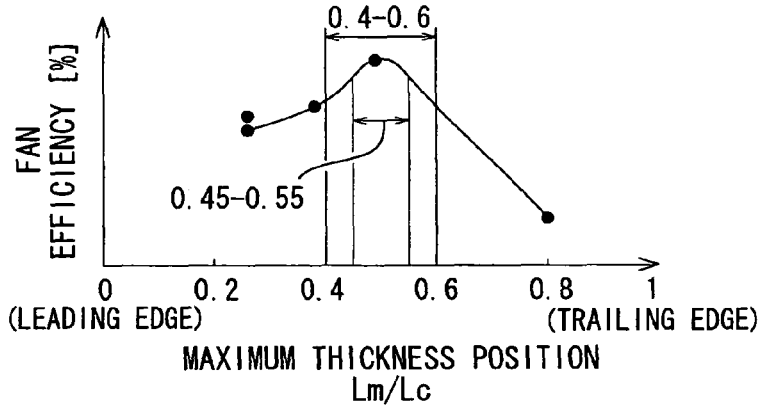
FIG. 5B is a graph showing a relationship between the maximum thickness position of the blades and a fan efficiency according to the first embodiment.

FIG. 5A is a graph showing a relationship between a maximum thickness position of each blade 13 from the leading edge to the trailing edge and a specific noise level. FIG. 5B is a graph showing a relationship between the maximum thickness position of each blade 13 and a fan efficiency η. FIG. 5A and FIG. 5B show examination results measuring the specific noise level and the fan efficiency η at a work point for several types of the blades 13 having different maximum thickness position. Transverses are the ratio Lm/Lc of the distance Lm from the leading edge 22 to the maximum thickness position and the chord length Lc.

As shown in FIG. 5A and FIG. 5B, by setting the above ratio Lm/Lc in the range of 0.4 to 0.6, the specific noise level and the fan efficiency η are improved. In addition, by setting the ratio Lm/Lc in the range of 0.45 to 0.55, the specific noise level and the fan efficiency η are more improved.

When the maximum thickness position is located on a side of the trailing edge 25 (Lm/Lc=1) than the thickness portion 28 (Lm/Lc=0.5), the specific noise level and the fan efficiency η become worse. It is for the reason described below.

As is well known, for increasing an air volume blown to the side of the rotation direction "a" of the fan 11, it is effective to increase the distance between the blades 13 in a vicinity of the trailing edge 25 on the side of the rotation direction "a" of the fan 11, and to enlarge an air passage area in the vicinity of the trailing edge 25.

By setting the maximum thickness position in the vicinity of the trailing edge 25, the distance between the blades 13 is shorten, and the air volume blown to the side of the rotation direction "a" of the fan 11 is reduced. Therefore, the fan efficiency η becomes worse. In addition, when the air volume is reduced, the rotation number of the fan 11 must be increased to blow a predetermined air volume. Therefore, the specific noise level becomes worse in accordance with increasing the rotation number of the fan 11.

Figure 6:
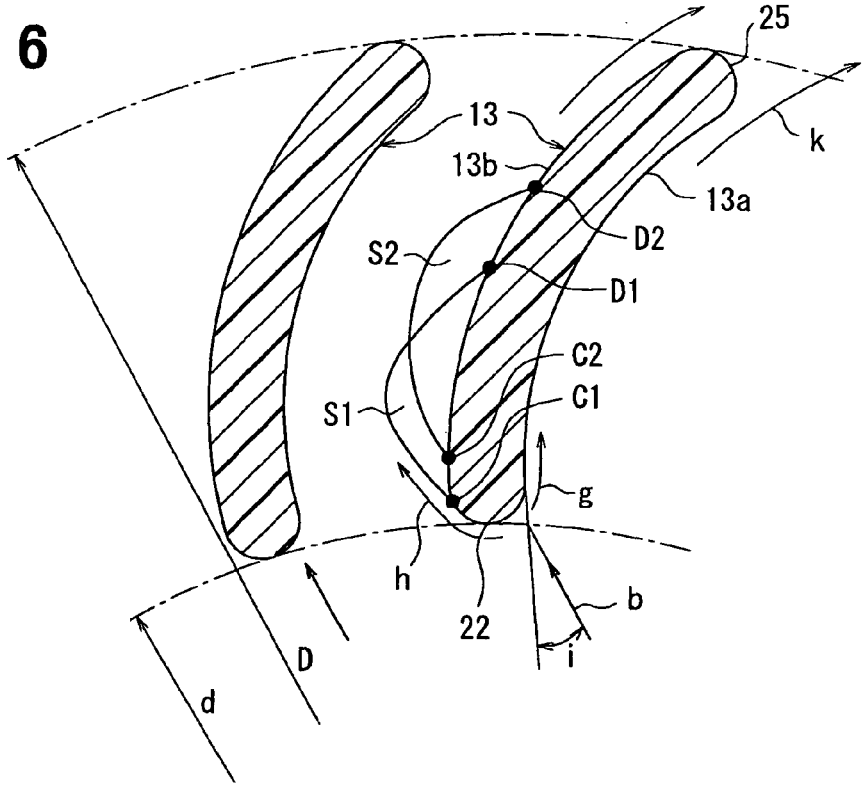
FIG. 6 is an enlarged cross-sectional view showing a part of a centrifugal multiblade fan according to a comparative example 2.
Figure 7A:
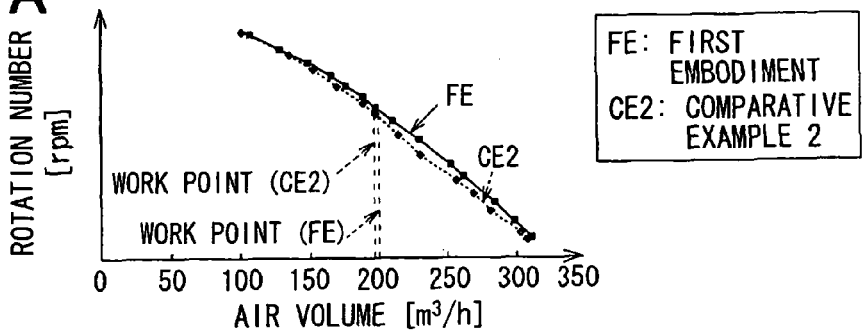
FIG. 7A-FIG. 7D are graphs showing effects due to the invention.
Figure 7B:
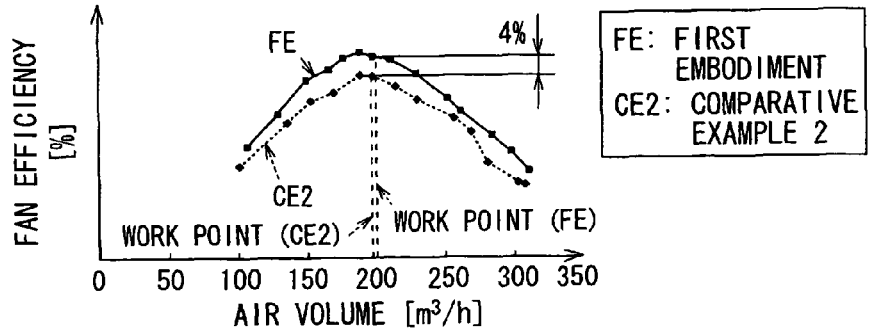
Figure 7C:
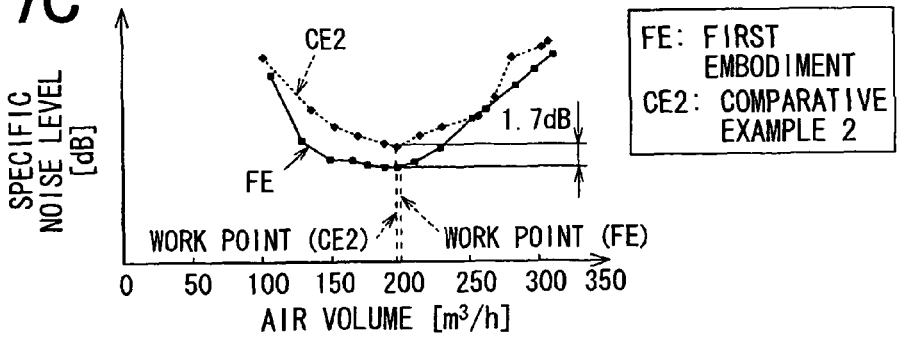
Figure 7D:
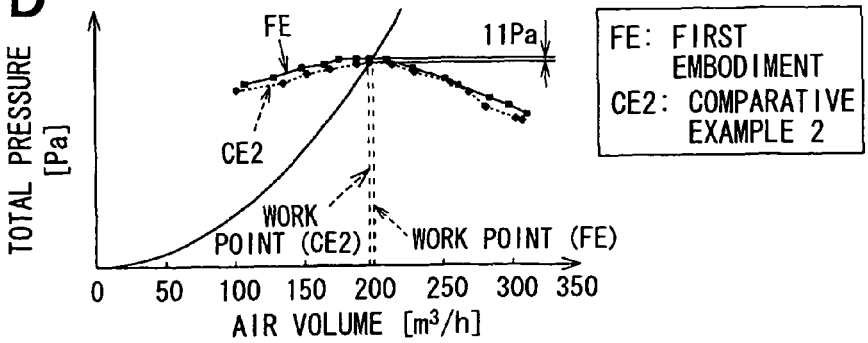

FIG. 6 is an enlarged cross-sectional view showing a part of a centrifugal multiblade fan according to a comparative example 2. In the comparative example 2, the blade thickness of each blade 13 is substantially constant in the chordwise direction, and the leading edge 22 and the trailing edge 25 of each blade 13 have smooth curved shapes against the first embodiment.

When the leading edge 22 has a smooth curved shape like the comparative example 2, in the air flowing toward each blade 13 (as shown by the arrow "b"), the air hit against the leading edge 22 is divided into air flowing toward a side of the ventral surface 13*a* as shown by the arrow "g" and air flowing toward a side of the back surface 13*b* as shown by the arrow "h". The air "g" flowing toward the side of the ventral surface 13*a* flows along the concave shape of the ventral surface 13*a*, and is blown to the radial outside of the fan 11 as shown by the arrow "k".

On the other hand, the air "h" flowing toward the side of back surface 13*b* cannot flow along the back surface 13*b*, and the airflow separates from the back surface 13*b*.

According to experiments by the inventor of the present application, a separation point where the airflow separates temporally fluctuates as shown by points C1 and C2 in FIG. 6. In accordance with the fluctuation of the separation point, the reattachment points D1, D2 of the separated airflow also temporally fluctuate as shown in FIG. 6.

Because of the fluctuation of the separation points C1 and C2 and the reattachment points D1 and D2, the separation area also fluctuate as shown by S1 and S2 in FIG. 6, and the airflow between the blades 13 becomes unstable. Therefore, the fan efficiency η is reduced and the noise is generated.

In the first embodiment, as shown in FIG. 4, at least the second angle part 22*b* is formed into the edge shape with the radius of curvature of 0.2 mm or less, so the airflow always separates from the line of the back surface 13*b* by the second angle part 22*b*. Because the fluctuation of the separation point, the reattachment point and the separation area of the airflow can be prevented, the airflow between the blades 13 can be restricted to be unstable. Therefore, the fan efficiency η can be improved and the noise can be reduced.

FIG. 7A-FIG. 7D are graphs showing effects of the invention, and showing examination results on the first embodiment (FE) comparing with examination results on the comparative example 2 (CE2). FIG. 8 shows specification of the blades 13 used for measuring in FIG. 7A-FIG. 7D. The above examination is compliant with JIS B 8330 and JIS B 8346. An inlet angle, an outlet angle and a stagger angle are defined according to JIS B 0132.

As shown in FIG. 7A-FIG. 7D, by comparing the fan total pressure Pt, the fan efficiency η and the specific noise level at the work point (a point at an intersection of a draft resistance curve and the fan total pressure Pt) in the first embodiment with those in the comparative example 2, the fan total pressure Pt can be increased by 11 Pa, the fan efficiency η can be improved by 4% and the specific noise level can be reduced by 1.7 dB.

When the first angle part 22*a* and the second angle part 22*b* have edge shapes, an edge tone is generated in the hit of the airflow against the first angle part 22*a* and the second angle part 22*b*, and the specific noise level is increased. However, a reduced level of the specific noise level by the above effects is larger than an increased level of the specific noise level by the edge tone. Therefore, in the first embodiment, the specific noise level is reduced as the whole.

Second Embodiment

Figure 9:
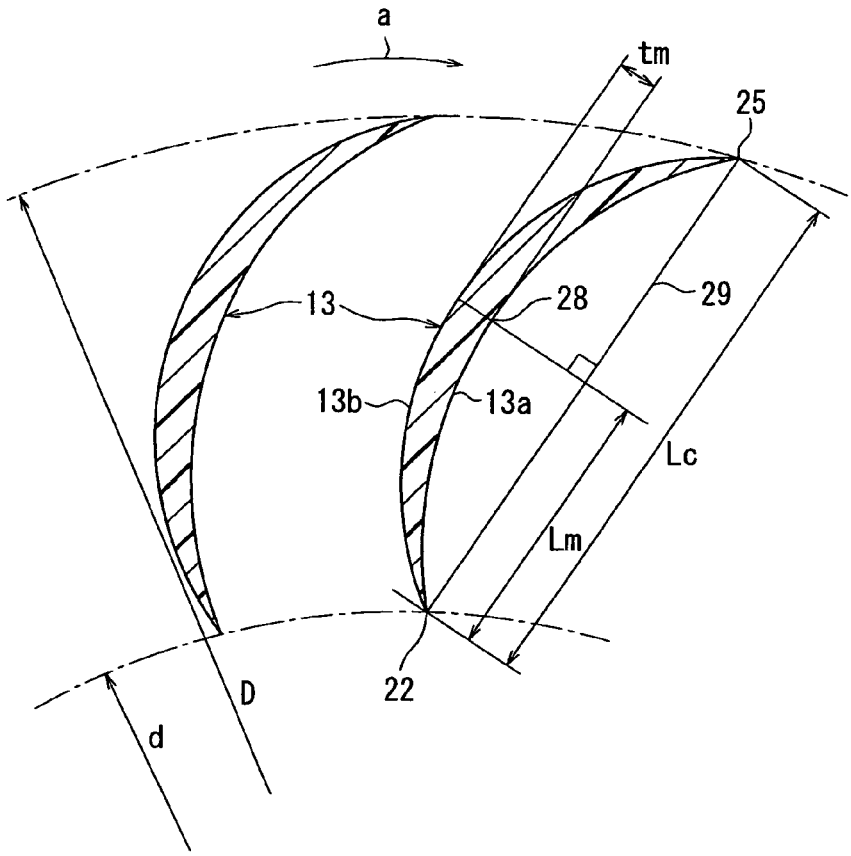
FIG. 9 is an enlarged cross-sectional view showing a part of a centrifugal multiblade fan according to the second embodiment.

In the above-described first embodiment, the first angle part 22*a* and the second angle part 22*b* are formed separately from each other at the leading edge 22 of each blade 13. However, in the second embodiment, as shown in FIG. 9, the first angle part 22*a* and the second angle part 22*b* are not formed at the leading edge 22, and the leading edge 22 is formed into a sharply peaked shape.

In addition, in the second embodiment, the third angle part 25*a* and the fourth angle part 25*b* of the first embodiment are not formed at the trailing edge 25 of each blade 13, and the trailing edge 25 is also formed into a sharply peaked shape.

In the second embodiment, because the leading edge 22 is formed into a sharply peaked shape, the airflow always separates at the leading edge 22. Therefore, effects similar to the first embodiment can be obtained.

In addition, in the second embodiment, the blade thickness on the side of the leading edge 22 and the side of the trailing edge 25 can be thinner than those in the first embodiment. Because the air passage formed between the blades 13 can be expanded than that in the first embodiment, the air volume blown from the fan 11 can be increased than that in the first embodiment.

In the second embodiment, the other features of the blades 13 can be made similarly to those of the first embodiment.

Third Embodiment

In the above-described first embodiment, the blade thickness of each blade 13 is increased gradually from both the leading edge 22 and the trailing edge 25 to the thickness portion 28 in the chordwise direction. However, in the third embodiment, the blade thickness is substantially constant in the chordwise direction as shown in FIG. 10.

Although, in the third embodiment, the trailing edge 25 of each blade 13 is formed into a smooth curved shape in cross section, the third angle part 25*a* and the fourth angle part 25*b* may be formed separately at the trailing edge 25 like the first embodiment.

In the third embodiment, because the second angle part 22*b* is formed into the edge shape, the airflow can always separate at the second angle part 22*b*. The separated airflow reattaches to each blade 13 at a reattachment point E, and the separation area S of the airflow is formed on the side of the back surface 13*b* of each blade 13.

Figure 10:
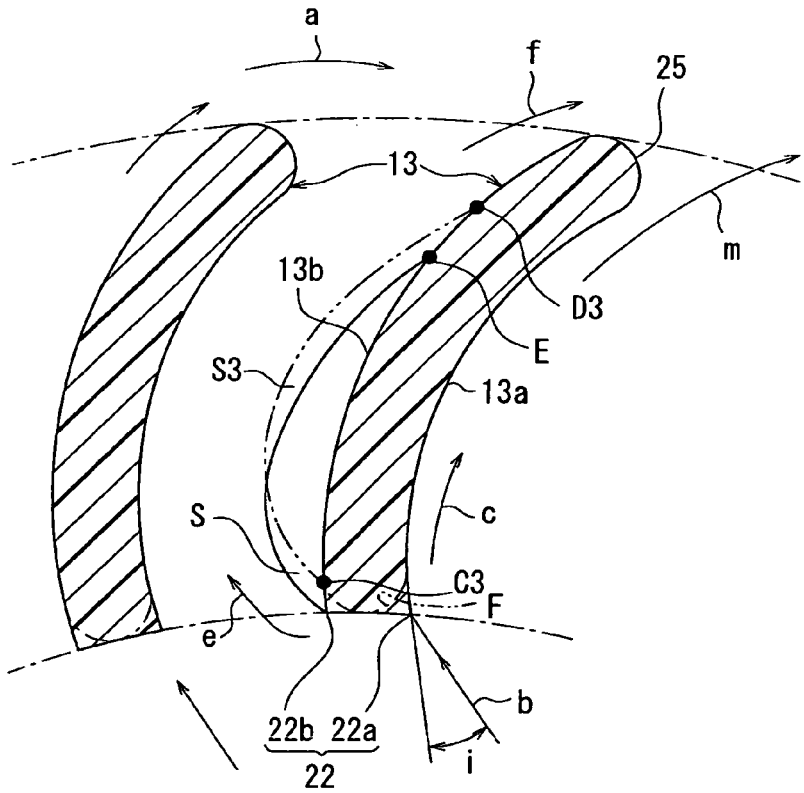
FIG. 10 is an enlarged cross-sectional view showing a part of a centrifugal multiblade fan according to the third embodiment.

In FIG. 10, the comparative example 2 is shown by a dashed-two dotted line F. In the comparative example 2, the leading edge 22 of each blade 13 is formed into a smooth curved shape against the third embodiment.

As described above, in the comparative example 2, the leading edge 22 is the smooth curved shape in cross section, so the separation point, the reattachment point and the separation area temporally fluctuate. In the comparative example 2, at the most upstream of the airflow, a separation point is shown by C3, a reattachment point is shown by D3, and a separation area is shown by S3 in FIG. 10.

When the leading edge 22 is the edge shape as the third embodiment, the separation point can be positioned at the upstream side of the airflow than that in the comparative example 2, so the reattachment point E and the separation area of the airflow S can be positioned at the upstream side of the airflow.

Because the distance that the airflow can be rectified between the blades 13 on the side of the trailing edge 25 increases, the airflow blown from between the blades 13 is made stable in the third embodiment. As a result, the centrifugal multiblade fan according to the third embodiment can improve the fan efficiency as well as reduce the noise.

The effect described in the third embodiment can be also obtained in the first embodiment and the second embodiment. That is, in the blades 13 in which the blade thickness increases gradually from both the leading edge 22 and the trailing edge 25 to the thickness portion 28, by forming the leading edge 22 into the edge shape, the separation point, the reattachment point E and the separation area S can be positioned at the upstream side of the airflow than when the leading edge 22 is the smooth curved shape in cross section.

In the third embodiment, the other features of the blades 13 can be made similarly to those of the first embodiment.

Other Embodiments

Although the present invention has been fully described in connection with the preferred embodiments thereof with reference to the accompanying drawings, it is to be noted that various changes and modifications will become apparent to those skilled in the art.

For example, in the first embodiment, not only the second angle part 22*b* but also the first angle part 22*a*, the third angle part 25*a* and the fourth angle part 25*b* are formed in to the edge shapes. However, the first angle part 22*a*, the third angle part 25*a* and the fourth angle part 25*b* are not necessarily to be the edge shapes. For example, they may be formed into circular arc shapes with a radius of curvature over 0.2 mm. In the first embodiment, at least the second angle part 22*b* is formed into the edge shape, and the other shapes of the first angle part 22*a*, the third angle part 25*a* and the fourth angle part 25*b* can be suitably changed.

In the second embodiment, not only the leading edge 22 of the blade 13 but also the trailing edge 25 is formed into the sharply peaked shape. However, the trailing edge 25 is not necessarily to be a sharply peaked shape. For example, it may be formed into a circular arc shape with a radius of curvature over 0.2 mm.

Such changes and modifications are to be understood as being within the scope of the present invention as defined by the appended claims.

What is claimed is:

1. A centrifugal multiblade fan that sucks air from one end side of an axial direction of a rotation axis to a radial inside of the centrifugal multiblade fan, and blows the air to a radial outside of the centrifugal multiblade fan, the centrifugal multiblade fan comprising a plurality of blades located around the rotation axis, wherein each blade has a leading edge positioned at the radial inside, and a trailing edge positioned at the radial outside, wherein each blade has a ventral surface on a forward side in a rotation direction, and a back surface opposite to the ventral surface, wherein the leading edge has a first angle part on a side of the ventral surface, and a second angle part on a side of the back surface, wherein at least the second angle part has an edge shape with a radius of curvature R of 0.2 mm or less, and wherein a blade thickness of each blade increases gradually from both the leading edge and the trailing edge to a thickness portion in a chordwise direction.

2. The centrifugal multiblade fan according to claim 1, wherein a ratio (Lm/Lc) of a chordwise distance (Lm) from the leading edge to the thickness portion and a chord length (Lc) from the leading edge to the trailing edge of each blade is set in a range from 0.4 to 0.6.

3. The centrifugal multiblade fan according to claim 2, wherein the ratio (Lm/Lc) is set in a range from 0.45 to 0.55.

4. A centrifugal multiblade fan that sucks air from one end side of an axial direction of a rotation axis to a radial inside of the centrifugal multiblade fan, and blows the air to a radial outside of the centrifugal multiblade fan, the centrifugal multiblade fan comprising a plurality of blades located around the rotation axis, wherein each blade has a leading edge positioned at the radial inside, and a trailing edge positioned at the radial outside, each blade has a ventral surface on a forward side in a rotation direction, and a back surface opposite to the ventral surface, the leading edge has a first angle part on a side of the ventral surface, and a second angle part on a side of the back surface, at least the second angle part has an edge shape, a blade thickness of each blade increases gradually from both the leading edge and the trailing edge to a thickness portion in a chordwise direction, the first angle part is located at a first distance from a rotation center of the plurality of blades, the second angle part is located at a second distance from the rotation center, and the first distance is equal to the second distance.

5. The centrifugal multiblade fan according to claim 4, wherein the leading edge has a substantially flat surface on the radial inside.

6. A centrifugal multiblade fan that sucks air from one end side of an axial direction of a rotation axis to a radial inside of the centrifugal multiblade fan, and blows the air to a radial outside of the centrifugal multiblade fan, the centrifugal multiblade fan comprising a plurality of blades located around the rotation axis, wherein each blade has a leading edge positioned at the radial inside, and a trailing edge positioned at the radial outside, wherein each blade has a ventral surface on a forward side in a rotation direction, and a back surface opposite to the ventral surface, wherein the leading edge has a first angle part on a side of the ventral surface, and a second angle part on a side of the back surface, wherein at least the second angle part has an edge shape such that air from the one end side of the axial direction of the rotation axis is always separated at the second angle part, and wherein a blade thickness of each blade increases gradually from both the leading edge and the trailing edge to a thickness portion in a chordwise direction.

7. The centrifugal multiblade fan according to claim 1, wherein the blade thickness of each blade increases gradually from both the leading edge and the trailing edge over an entire length of the leading edge and an entire length of the trailing edge.

8. The centrifugal multiblade fan according to claim 4, wherein the blade thickness of each blade increases gradually from both the leading edge and the trailing edge over an entire length of the leading edge and an entire length of the trailing edge.

9. The centrifugal multiblade fan according to claim 6, wherein the blade thickness of each blade increases gradually from both the leading edge and the trailing edge over an entire length of the leading edge and an entire length of the trailing edge.

10. The centrifugal multiblade fan according to claim 1, wherein the leading edge and the trailing edge of each blade is generally parallel to the axial direction of the rotation axis.

11. The centrifugal multiblade fan according to claim 4, wherein the leading edge and the trailing edge of each blade is generally parallel to the axial direction of the rotation axis.

12. The centrifugal multiblade fan according to claim 6, wherein the leading edge and the trailing edge of each blade is generally parallel to the axial direction of the rotation axis.

13. The centrifugal multiblade fan according to claim 1, wherein the entire trailing edge of each of the plurality of blades is positioned along the rotation direction.

14. The centrifugal multiblade fan according to claim 1, wherein each of the plurality of blades has a circular arc shape in cross section.

15. The centrifugal multiblade fan according to claim 1, wherein:

the first angle part is located at a first distance from a rotation center of the plurality of blades, the second angle part is located at a second distance from the rotation center, and the first distance is equal to the second distance.

16. The centrifugal multiblade fan according to claim 4, wherein the entire trailing edge of each of the plurality of blades is positioned along the rotation direction.

17. The centrifugal multiblade fan according to claim 4, wherein each of the plurality of blades has a circular arc shape in cross section.

18. The centrifugal multiblade fan according to claim 6, wherein the entire trailing edge of each of the plurality of blades is positioned along the rotation direction.

19. The centrifugal multiblade fan according to claim 6, wherein each of the plurality of blades has a circular arc shape in cross section.

20. The centrifugal multiblade fan according to claim 6, wherein:

the first angle part is located at a first distance from a rotation center of the plurality of blades, the second angle part is located at a second distance from the rotation center, and the first distance is equal to the second distance.

* * * * *